US005296644A

United States Patent [19]

Aoki

[11] Patent Number: 5,296,644

[45] Date of Patent: Mar. 22, 1994

[54] CHORD DETECTING DEVICE AND AUTOMATIC ACCOMPANIMENT DEVICE

[75] Inventor: Eiichiro Aoki, Hamamatsu, Japan

[73] Assignee: Yamaha Corporation, Hamamatsu, Japan

[21] Appl. No.: 919,306

[22] Filed: Jul. 24, 1992

[30] Foreign Application Priority Data

Jul. 24, 1991 [JP] Japan ..... 3-184545

[51] Int. Cl.[5] ..... G10H 1/38

[52] U.S. Cl. ..... 84/637; 84/DIG. 22

[58] Field of Search ..... 84/613, 637, DIG. 22

[56] References Cited

U.S. PATENT DOCUMENTS 5,153,361 10/1992 Kozuki ..... 84/613

FOREIGN PATENT DOCUMENTS 252277 11/1990 Japan .

*Primary Examiner*—Stanley J. Witkowski

*Attorney, Agent, or Firm*—Spensley Horn Jubas & Lubitz

[57] ABSTRACT

A chord detecting device has memories for storing note data and a first chord of a first section in a bar, and a tonality data supplier. A chord in a second section of the bar is detected according to note data at the beginning of the second section of the bar, the tonality data and the first chord. The chord detecting device further includes a temporary chord detecting device for detecting the temporary chord at a beginning of the first section, and a fixed chord detecting device for detecting a fixed chord at the beginning of the second section. The temporary chord is detected by a fixed chord of a section immediately before, the tonality data and note data at the beginning of the first section, and the fixed chord is detected by note data within the first section, the tonality data and the temporary chord. An automatic accompaniment device includes the chord detecting device and an accompaniment device for generating accompaniment tones based on the temporary chord.

9 Claims, 10 Drawing Sheets

C MAJOR (CHORD EXTRACTION TABLE)

| MELODY NOTE | C | D | E | F | G | A | B |
|---|---|---|---|---|---|---|---|
| CHORD | F | G | Am | Bm(65) | C | Dm | Em |
| | Am | Bm(65) | C | Dm | Em | F | G |
| | C | Dm | Em | F | G | Am | Bm(65) |
| | | G7 | | G7 | G7 | | G7 |

FIG. 2 (A)

CANDIDATE TONE GENERATION CHORD

C MAJOR (CHORD EXTRACTION TABLE)

FIXED CHORD IMMEDIATELY BEFORE

| | C | Dm | Em | F | G7 | Am | Bm(b5) | OTHER |
|---|---|---|---|---|---|---|---|---|
| C | 2 | 4 | 6 | 1 | 3 | 5 | 7 | 8 |
| C# | | | | | | | | |
| ⋮ | | | | | | | | |
| B | | | | | | | | |
| Cm | | | | | | | | |
| ⋮ | | | | | | | | |
| Bm | | | | | | | | |
| C7 | | | | | | | | |
| ⋮ | | | | | | | | |
| B7 | | | | | | | | |

FIG. 2 (B)

CHORD DETECTING DEVICE AND AUTOMATIC ACCOMPANIMENT DEVICE

BACKGROUND OF THE INVENTION

1. Field of the invention

The present invention relates to an art to obtain chords or the like by analyzing playing data, more particularly to improvement of an art to obtain more precise chord data and to an automatic accompaniment device for automatic accompaniment based on the obtained chord data.

2. Prior art

In general, in automatic accompaniment devices provided in electronic musical instruments, a keyboard is divided into two parts, a left side and a right side. A player uses the left side of the keyboard for designating a chord with his left hand, and the right side thereof for playing a melody.

Since this type automatic accompaniment device enables the player to designate any desired chord, his favorite accompaniment can be performed. In the case where a complex melody is played in the right side with both hands, however, chords cannot be designated with his left hand in the left side, resulting in an impossible situation of the accompaniment playing. At the same time, if the player makes a miss-touch of the chord designation, the chord decided immediately before is held because a new chord can't be decided based on a combination of the miss-touched keys. Also, chord detection in which chord is detected based on actual playing without any chord designation has been proposed. Furthermore, Japanese patent publication hei 2-52277 discloses that a tonality of music to be played is inputted at the beginning of playing and a chord is decided based on the tonality and on one tone pitch of a melody.

In the above mentioned prior art, Japanese patent publication hei 2-52277 has the disadvantage that the decided chord is inaccurate, because the chord is decided based on only one tone pitch and the tonality.

SUMMARY OF THE INVENTION

It is therefore an object of the present invention to detect precisely a chord by taking chord progress into consideration, unless there is no direct specifying information for that chord.

It is another object of the present invention to provide a chord detection device which is capable of detecting a precious chord by using more note data and taking chord progress into consideration, and performing an automatic accompaniment precisely based on the detected chord.

It is a further object of the present invention to provide a chord detection device which is capable of imparting a more appropriate chord without keeping the previous chord merely in case a player specifies a wrong chord.

It is a still further object of the present invention to provide an automatic accompanying device which is capable of generating appropriate accompaniment tones.

In accordance with an embodiment of the present invention, a chord detecting device comprises note data storage means for storing note data of music for each specified section in each bar, first chord storage means for storing a first chord corresponding to the note data of a first section in the bar, tonality data supply means for supplying tonality data, and, chord imparting means for imparting a second chord in a second section of the bar according to note data at a beginning in the second section, the tonality data being supplied by the tonality data supply means, and the first chord being stored in the first chord storage means.

Also, the chord detecting device can include temporary chord imparting means for imparting a temporary chord to a first section of a bar at a beginning of the first section according to a previous chord (a fixed chord) of a section immediately before, the tonality data and note data corresponding to the beginning of the first section being stored in the note data storage means, and, fixed chord imparting means for imparting a fixed chord to the first section of the bar at a beginning of a second section of the bar according to note data within the first section stored in the note data storage means, the tonality data and the temporary chord of the first section being imparted by the temporary chord imparting means.

Further, an automatic accompaniment device includes the chord detecting device and accompaniment means for generating accompaniment tones based on the temporary chord.

According to the above arrangement, since a chord in the second section is imparted according to the note data at the beginning in the second section, the tonality data and the chord in the first section, the imparted chord in the second section will become correct. Also, since the temporary chord is detected according to the note data at the beginning in the first section, the tonality data and the previous section's fixed chord, the accompaniment will be assumed to be correct.

BRIEF DESCRIPTION OF THE DRAWINGS

FIGS. 2(A) and 2(B) illustrate a chord extraction table and a priority order table, respectively.

DETAILED DESCRIPTION OF THE PREFERRED EMBODIMENT

Figure 1:
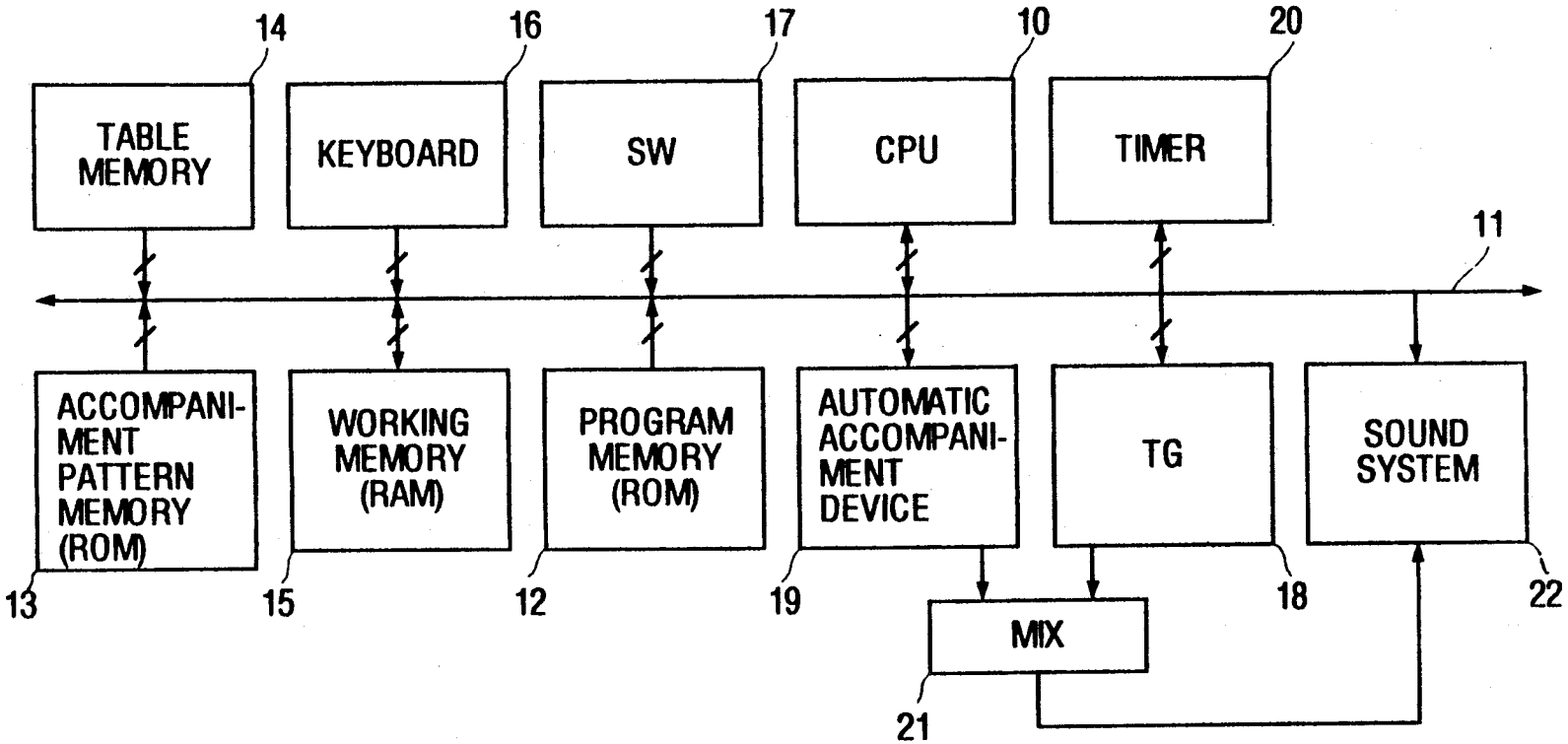
FIG. 1 is a block diagram of an electronic musical instrument embodying the present invention.

FIG. 1 is a block diagram of an electronic musical instrument embodying the present invention. The electronic musical instrument is an electronic type instrument provided with a keyboard 16. The keyboard 16 is divided into two areas. The left side of the keyboard (lower tone pitch side) having about one octave serves for designating a chord by depression of keys to thereby play the accompaniment. The other area (the right side) provides for an ordinal melody playing. This musical instrument is so arranged that a chord is designated by turned-on keys in the left side or is detected based on a melody flow in the right side, and the automatic accompanying is performed according to the designated or the detected chord. The electronic musical instrument is controlled by a CPU 10. The CPU 10 is connected to a program memory 12, an accompaniment pattern memory 13, a table memory 14, a working memory 15, a keyboard 16, a switch group 17, a tone generator 18, and an automatic accompaniment device 19. The program memory 12, the accompaniment memory 13 and the table memory 14 are configured by a ROM, and store a process program, an accompaniment pattern for each genre or chord type, and a chord detection table shown in FIG. 2, respectively. The working memory 15 is provided with registers used for the process of the electronic musical instrument. The keyboard 16 is a keyboard having about five octaves divided into the left and the right sides described above. The switch group 17 includes a tone color selection switch, an accompaniment selection switch and the like. The accompaniment selection switch is a switch for selecting an automatic accompaniment pattern, a rhythm pattern and the like. The tone generator 18 has a plurality of tone generation channels, each of which generates a musical tone signal simultaneously and individually. The automatic accompaniment device 19 is a device which automatically generates automatically accompaniment tones based on the designated chord, rhythm pattern and the like. The musical tone signals generated by the tone generator 18 and the automatic accompaniment device 19 are inputted into a mixer 21. The mixer 21 is connected to a sound system 22. The musical tone signals inputted into the sound system 22 from the mixer 21 are amplified and outputted to a speaker or the like. A timer 20 is connected to the CPU 10. The timer 20 has a function to interrupt the CPU 10 for every one beat and every 5 ms after each beat.

FIG. 2 shows a chord extraction table and a prior order table stored in the table memory 14. FIG. 2 shows the chord extraction table. This table stores chords, formed by only scale tones, each of which includes the tone name (note name) of each tone pitch in C major. The type of the stored chord is a triad type except a dominant 7th chord (G7) This table is a C major table. It is possible to apply the table to other major keys by shifting the tone names. Regarding minors, it is necessary to provide a C minor table. The below description relates to the major mode. The same description can be applied to the minor mode.

FIG. 2(B) shows the prior order table. This table is used when the detected key is C major. The table stores the prior order of chord progression in the C major key. Namely, the table stores the prior order of the chord which is proper at a given time according to the fixed chord of a section (of a bar) immediately before. For example, when the fixed chord immediately before is C major in the C major key, it is better to move to an F major next. The next idea is to keep the C major instead of moving to F major. The fixed chord is selected out of all the chords whose roots are tones of the chromatic scale, while the chords that the priority orders are imparted to order table are limited to the chords whose roots are tones of the diatonic scale. That's because of probability that tones other than the scale tones are unsuitable to detect any chord is high. First, a plurality of candidate chords are extracted from the chord extraction table shown in FIG. 2(A), and then the chord of the highest priority order is selected as a tone generation chord (a chord to be actually generated) from the priority order table.

FIGS. 3 to 12 are flowcharts showing a process, in quadruple time music, of the above electronic musical instrument.

Figure 3:
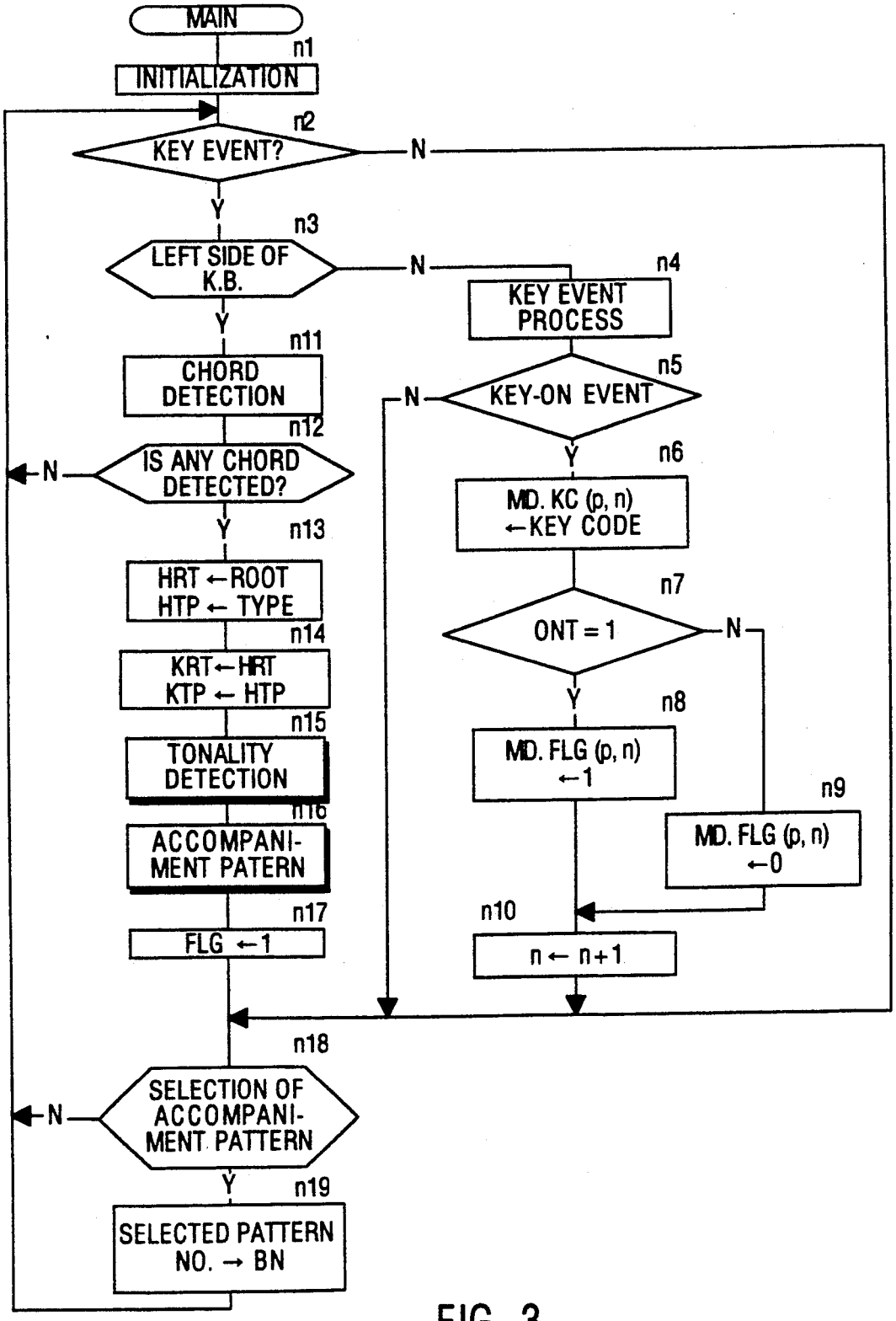
FIGS. 3 to 12 comprise flowcharts showing a process of the electronic musical instrument.

FIG. 3 shows a main routine. When the power of the electronic musical instrument is turned on, an intialization process is carried out. The initialization process includes a reset and a preset processes of registers. After that, whether any key event or any accompaniment selection operation (event) occurs or not is judged (n2, n18), and if the event has occurred the corresponding process is performed. If the key event has occurred, the process moves to step n3 from step n2. At step n3, whether the key event occurs at the left side area of the keyboard or not is judged. If the key event occurs at the left side area, the processes from step n11 to n17 may be performed. If the key event occurs at the right side area, the processes from step n4 to n10 may be performed. If the event key is included in the right side area, a key event process (n4) corresponding to the event key for processing a tone generation or a tone release is performed. If the event is the key-on event, the key code of the event key is stored into a melody key code register MD.KC(p,n). This register is a two-dimensional array with p rows and n columns. The "p" takes the value of "0" or "1", with "p=0" representing the first beat and the second beat of a bar and "p=1" representing the third beat and the forth beat of a bar. The "n" takes the value of one out of "0" to "N". The "N" is selected to be an appropriate value that can cover the number of melody tones played within two beats. Generally, in the quadruple time music, the minimum unit played with the same chord is the two beats section that consists of the first and the second beats or the third and the forth beats. Therefore, in this embodiment, one bar is divided into two sections, each of which consists of the first and the second beats and the third and the forth beats, respectively, and a chord is decided on for each section. Melody tones in each section are successively stored in the register MD.KC(p,n) [p=0,1] from n=0 as information for deciding a chord.

Next, whether a beat timing register ONT is "1" or not is judged (n7). This register ONT is set at the beat timing by an interrupt process. If ONT=1, the key chord is detected at the beat timing so that "1" is set into a beat timing melody flag MD.FLG(p,n) corresponding to the register MD.KC(p,n). If ONT=0, "0" is set into MD.FLG(p,n) (n9). After the process, "1" is added to a pointer n.

If the key event occurs in the left side of the keyboard, a chord is detected by a combination of keys turned on in the left side (n11). A well known table manner can be used for the chord detection. If any chord is detected, the root and the type of the detected chord are set into a tone-generation-chord-root-register HRT and a tone-generation-chord-type-register HTP (n13), and the set data are copied to a fixed chord root register KRT and a fixed chord type register KTP, respectively (n14). After that, a tonality is detected based on the chord progress (n15), and a read process of automatic accompaniment patterns is performed (n16). Also, the player precisely designates a chord by a combination of keys in the left side of the keyboard so that a chord designation flag FLG is set (n17).

If an accompaniment selection switch including the switch group 17 is turned on, the selected accompaniment number is set into a register BN (n19).

Figure 4:
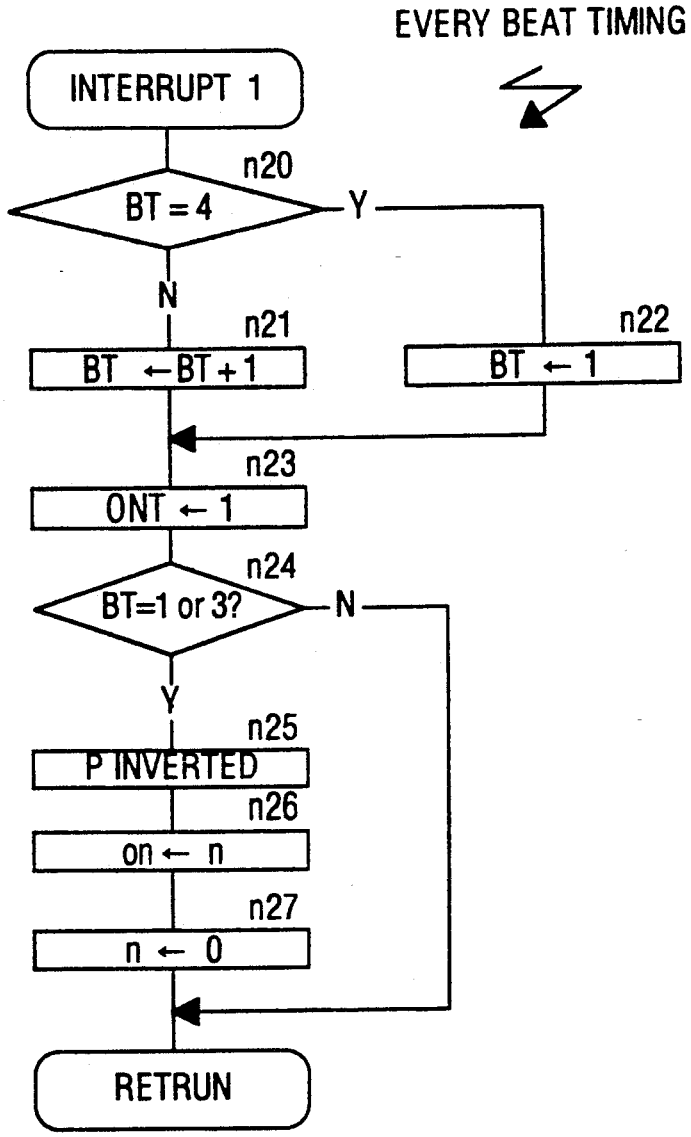

FIG. 4 is a flowchart showing the first interrupt process. This interrupt process is carried out at every beat timing in the quadruple time. First, whether a beat counter BT represents "4" or not is judged (n20). If "yes", the interrupt at this time occurs at the first beat timing of the next bar, and "1" is set into the register BT (n22). If "no", "1" is added to the register BT to advance one beat (n21). Next, "1" is set into the flag ONT representing the beat timing (n23). The flag register ONT is reset at the timing of the second interrupt process that is performed 5 ms after the timing of this first interrupt process Next, whether BT=1 or BT=3 or not is judged (n24). If "yes", since the first or the third beat is a strong beat and the beat is the beginning timing of the two beats section, "p" representative of row of the melody key code register MD.KC(p,n) is inverted (n25). Furthermore, the value of the pointer n is applied to the register on (n26), the register n is cleared (n27), and the process returns. If BT=2 or BT=4, the process immediately returns from n 24 since a chord should not be changed.

Figure 5:
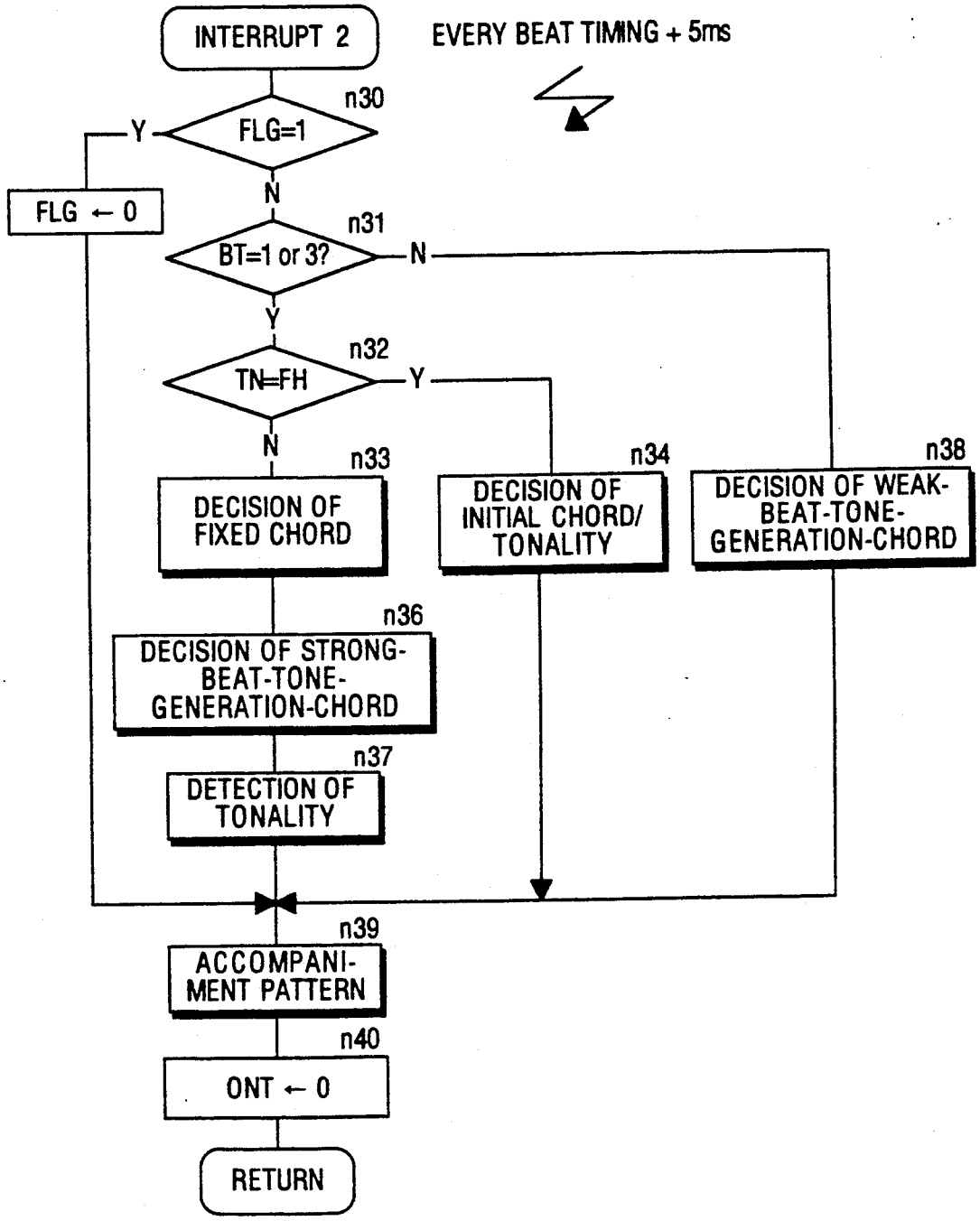

FIG. 5 is a flow chart showing the second interrupt process. The interrupt process is performed 5 ms after every beat timing. In this interrupt process, an accompaniment chord for each beat is decided. First, whether a chord designation flag FLG is set or not is judged (n30). If this flag is set, the process skips a chord and tonality decision process of n32 to n38 and moves to an accompaniment pattern read process (n39). Because, a chord is specified by a combination of keys in the left side keyboard, it is therefore unnecessary to decide a chord by various judgement processes. The flag FLG is reset in this case (n31). Then, the accompaniment pattern read process (n39) is carried out, the beat timing flag register ONT is reset (n40), and the process returns.

In the case that a chord is not specified by the player, if the present timing is the beginning one of music, the initial chord and the tonality decision process (n34) is performed. Whether the present timing is the beginning one of music or not is judged by checking whether "$F_H$" is set in the tonality register TN or not (n33). Namely, when music is started, the tonality decision process is always performed to decide a tonality. Therefore, if the tonality has not been decided ($TN=F_H$), the present timing can be decided as the beginning of the music. If the timing is the strong timing of the first or the third beat, and not the beginning of music, a fixed chord decision process (n35), a strong-beat-tone-generation-chord-decision process (n36), and the tonality decision process (n37) are performed. If the timing is the second or the forth beat timing, a weak-beat-tone-generation-chord-decision process (n38) is performed. After that, the process moves to step n39.

The fixed chord is an appropriate chord in two beats section. When a chord is specified in the left side of the keyboard, the chord is the fixed one. If no chord is specified, a chord actually generated is treated as a temporary fixed chord in the non-specified section, and the real fixed chord is decided based on the melody progress and the tonality after the section is ended.

Figure 6:
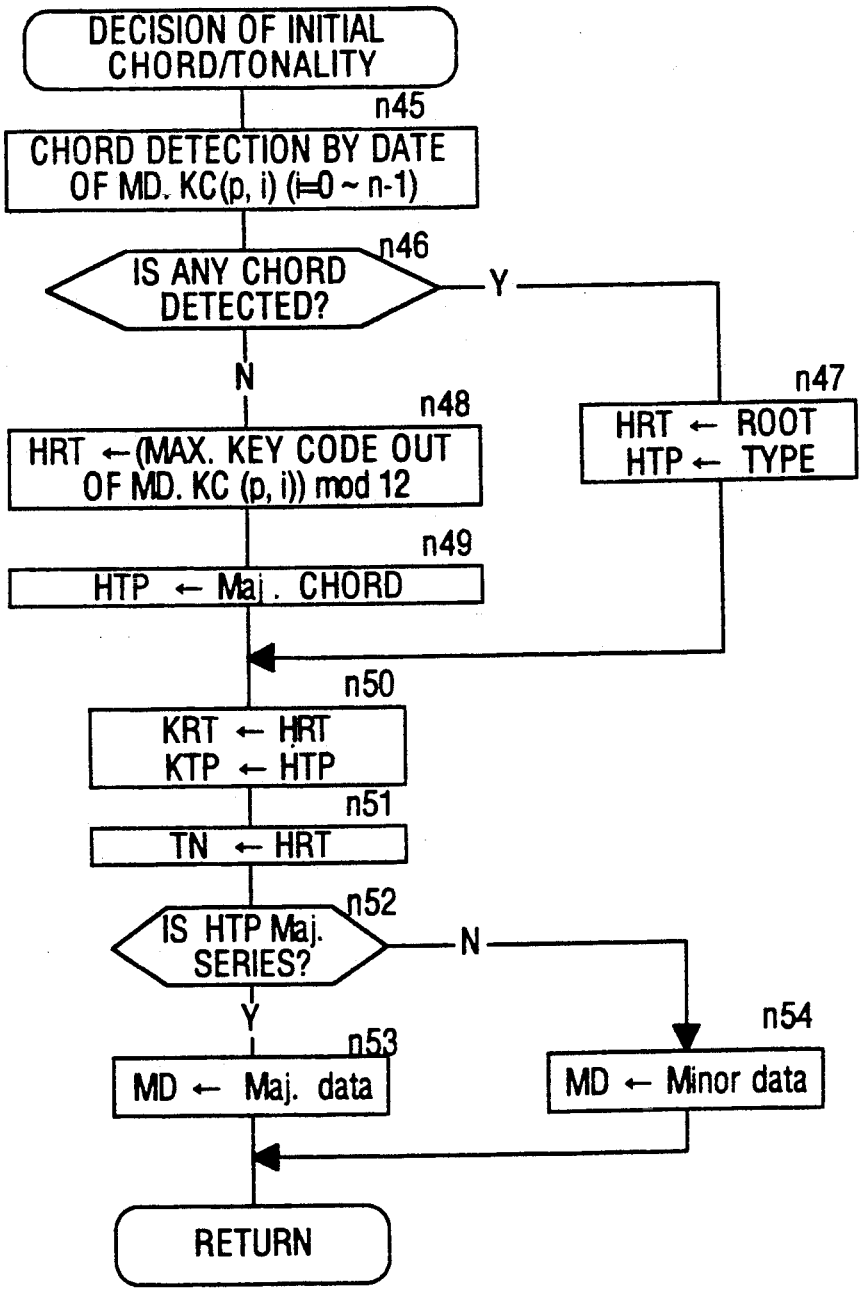

FIG. 6 is a flowchart showing the initial chord and tonality decision process for deciding a chord and a tonality based on melody tones in the case that no chord is specified at the beginning of music. First, a chord is detected based on a key code of MD.KC(p,i) turned on at the beginning of music (n45). Using the register MD.KC(p,i) allows a chord to decide according to not only one key but also a plurality of keys turned on simultaneously. When the chord is decided by this step, the root and the type of the chord are set into the registers HRT, HTP, respectively (n47). If any chord isn't detected, a maximum pitch tone out of all tones of the played melody is temporarily decided as the root, and the tone name of the root is set into the register HRT (n48). The type of the chord is a major one (n49). The contents of the registers HRT, HTP are copied to the registers KRT, KTP for the fixed chord, respectively (n50). Also, the tonality of the present music is decided as one whose tonic is the decided root (n51). The TN is a tonic register for storing data corresponding to a tonic tone name. Next, whether the type of the detected chord is major or minor is judged. If the type is major, the data corresponding to the major is set into a mode register MD (n53), and if the type is minor, the data corresponding to the minor is set into the mode register MD (n54).

Figure 7:
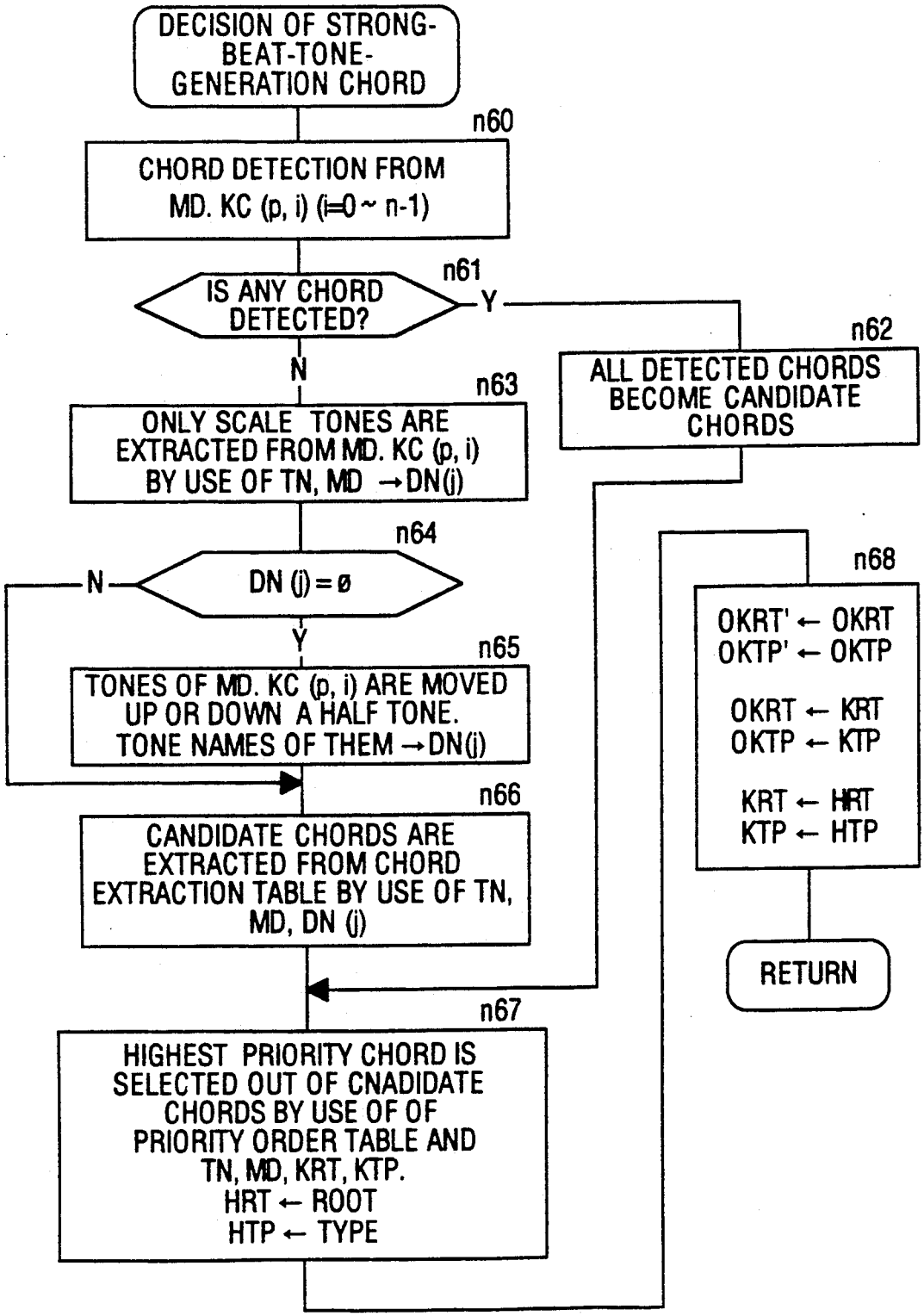

FIG. 7 is a flowchart showing the strong-beat-tone-generation-chord-decision process. This process provides that if any chord is not specified in the left side of the keyboard at the first or the third beat timing, a chord for an accompaniment is decided based on melody tones in the right side of the keyboard. First, a chord is detected according to a key code series of the melody key code register MD.KC(p,i) (n60). If at least one chord is detected at step n60, the chord is set as a candidate chord (n62), and the process moves to step n67. If no chord is detected, only scale tone is extracted from the data of the melody key code series, and the scale tone is set into a scale tone register DN(j) (n63). If no scale tone is extracted, each tone pitch of the melody key code series is moved up or down a half tone pitch so that each tone becomes the scale tone, and the key codes of the corrected tone pitches are set into the scale tone register DN(j) (n64, n65). Candidate chords are extracted from the chord extraction table shown in FIG. 2 (A) according to the contents of the register TN(j), a tonic TN of the present tonality and a mode (major mode or minor mode) MD (n66). At step n67, the highest priority order chord out of the candidate chords decided at step n62 or step n66 is selected as the tone generation chord. The decision of the chord is performed by searching in the priority order table (see FIG. 2 (B)) using the tonic (note) TN of the tonality, the mode MD, the root of the fixed chord KRT, and the type of the fixed chord KTP. The root and the type of the decided tone generation chord are set into the tone-generation-chord-root register HRT and the tone-generation-chord-type register HTP, respectively.

If the tone generation chord is decided, this chord becomes a temporarily fixed chord in the previous section. Before this temporarily fixed chord is applied to the fixed chord register, the fixed chords in the previous section and one more previous section are transferred to registers OKRT', OKTP', OHRT, OKTP, and the contents of HRT, HTP are copied to the fixed chord registers KRT, KTP, respectively (n68).

Figure 8:
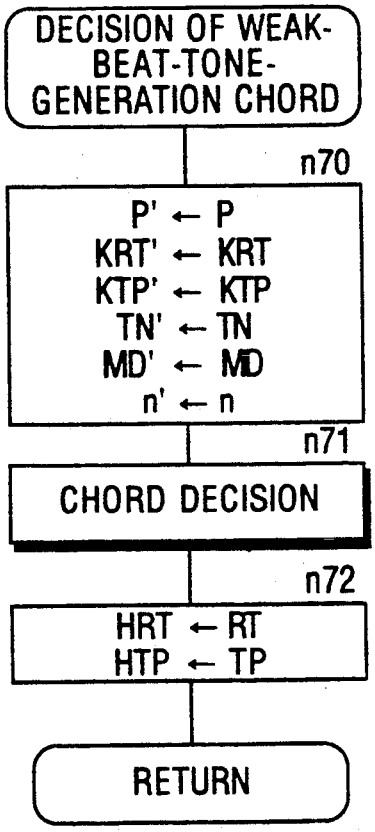
Figure 10:
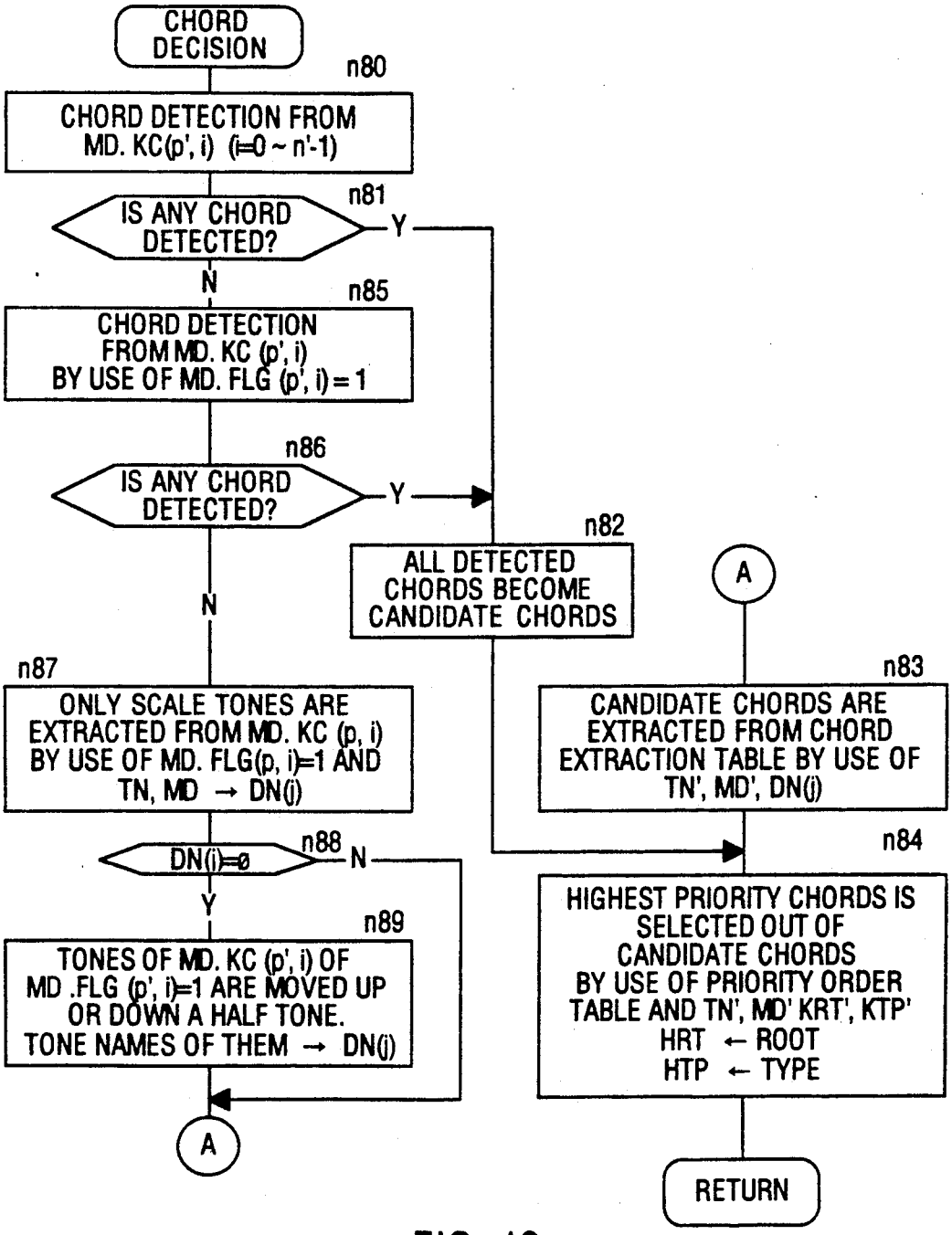

FIG. 8 is a flowchart showing the weak-beat tone generation chord decision process. This process is carried out when any chord isn't specified at the second and the forth beats in the left side of the keyboard. In this process, the decided chord by the chord decision process shown in FIG. 10 is set as the tone generation chord. Since the chord decision process in FIG. 10 is used in the fixed chord decision process described later, parameters of p, KRT, KTP, TN, MD, n are copied to a parameter register used in the chord decision process (n70). The chord decision process is performed by use of the parameters (n71). The root RT and type TP of the chord decided by this process are set as the root HRT and type HTP of the tone generation chord (n72).

Figure 9:
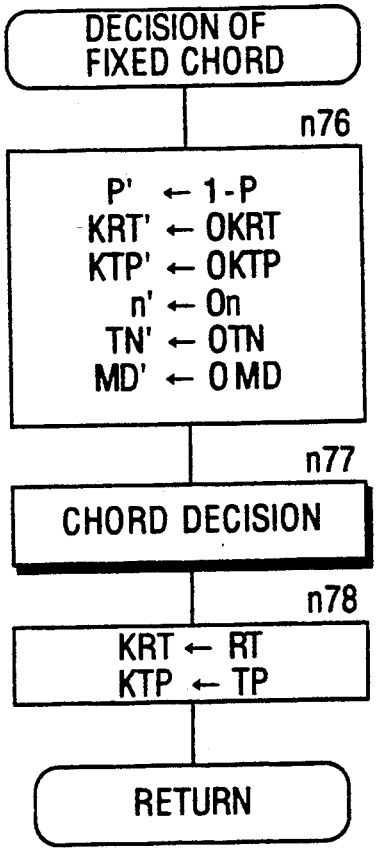

FIG. 9 is a flowchart showing the fixed chord decision process. This process decides retroactively the most appropriate chord in a two beat period immediately before at each head timing of the first and the third beats. This process is used to decide a tone generation chord together with a tonality and a key code of a melody when a chord isn't specified at the first beat or the third beat timing by an operation of keys in the left side of the keyboard. First, parameters are set in the parameter register to perform the chord decision process. At step n73, "1−p" is set in a p' register, and the contents of ODRT, OKTP, on are set into KRT', KTP', n', respectively. Further, the contents of OTN, OMD are set into TN', MD', respectively. Next, the chord decision process is performed (n77), and the root RD and the type TP of the decided chord by this process are set into KRT, KTP as the fixed chord data, respectively (n78).

FIG. 10 is a flowchart showing the chord decision process. This process decides one chord by use of the chord extraction table and the priority order table shown in FIG. 2, based on the contents of the melody key code register and the like. First, a chord is detected based on the melody key codes, which are obtained from the register MD.KC(p',i), in the section for deciding the chord (n80). If any chords have been detected, all the detected chords become the candidate chords (n82), with the process moving to n84. If a chord is not detected, the musical tones generated only at the beat timing represented by (MD.FLG(p',i)=1) are taken, and a chord is detected according to the tones (n85). If a chord is not detected, only scale tones are extracted from the melody tones generated at the beat timings, and the scale tones are set into the register DN(j) (n87). The scale tones are extracted on the basis of the tonic TN' and the mode MD'. If no scale tones can be extracted, each of the melody tones at each beat timing is moved up or down a half tone, and the moved tones are set into the register DN(j) (n88, n89). After the steps of n88, n89, all the candidate chords are searched from the chord extraction table according to the contents of DN(j), the tonic TN' and the mode MD' (n83). At step n84, the highest priority order chord is selected out of the candidate chords. This selection is carried out by selecting the priority order table for use and shifting the table contents according to TN', MD', and then by finding the priority order corresponding to the fixed chord KRT', KTP'. The root and the type of the selected chord are set into the registers RT and TP, respectively (n84).

Figure 11:
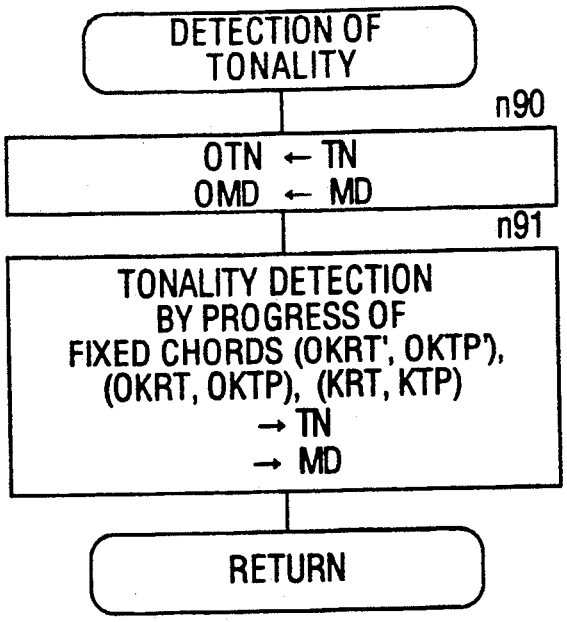

FIG. 11 is a flowchart showing the tonality detection process. In this process, first the tonic TN and the mode MD in the present set tonality are set into the registers OTN and OMD, respectively (n90). Next, the tonality is detected according to the progress of the fixed keys of the present time, the previous time and the prior to that time. Further the tonic and the mode of the detected tonality are set into the tonic register TN and the mode register MD. Regarding the detection of the tonality, Japanese patent Laid-open hei 2-83591 discloses detail information.

Figure 12:
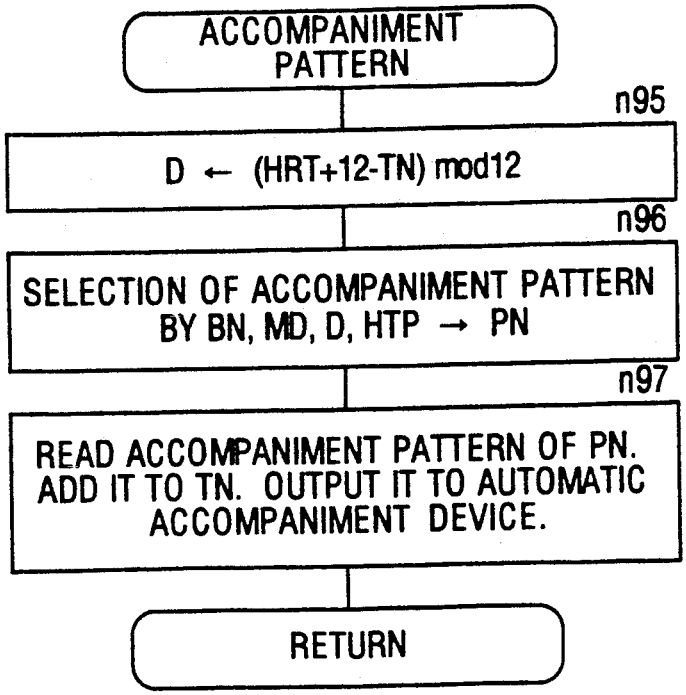

FIG. 12 is a flowchart showing the accompaniment pattern performing process. First, the tone interval between the root HRT of the tone generation chord and the tonic of the present tonality is calculated, and the result is set into the interval register D (n95). The accompaniment pattern is selected according to the interval D, the selected accompaniment kind BN, the tonality mode MN, and the type HTP of the tone generation chord, and the selected accompaniment pattern number is set into the register PN (n96). The accompaniment pattern specified by PN is read, and the key code of the musical tone actually generated is calculated by adding the read accompaniment pattern to the tonic data TN of the tonality. Further, the calculated key code is outputted to the automatic accompaniment device (n97).

According to the above mentioned process, unless any chord is specified in the left side of the keyboard, an appropriate chord is decided based on the prior chord, the key codes of the present melody and the like, resulting in a precise accompaniment.

In the above example, the chord extraction table and the priority order table each comprise a major type and a minor type. It is possible to provide the table for each accompaniment kind, i.e., each genre of music. Therefore, a specified chord progress can be realized for a specified genre. In the above example, a chord is detected based on key-on data in real time. It is possible to detect a chord based on chord information sent from a MIDI or the like.

In the above example, all melody key codes are stored in the melody key code register MD.KC(p,n). Since a short passage often includes chords irrelevant to any chord, the register can be arranged so that short tones in the passage aren't used for detecting a chord. Also, the data in the register can be weighed. The tables shown in FIG. 2 can include more complex chords to increase detectable chords. A chord kind can change according to a music style, feeling and genre. If there is a probability of the progress of the same chord pattern, it is better to vary the detected chord a little to avoid monotone. In the chord detection, it is possible to refer to two or more previous chords. In the above example, every transposition is allowed in the tonality detection. It is possible to limit the transposition range to near relation tonalities. If a non-scale tone is thought of as one composed of tones of a dominant chord to a triad having a root of any scale tone, it is possible that the non-scale tone is used for the chord detection.

As described above, a chord is decided based on a chord progress, a tonality and a plurality of melodies. A precise chord detection can be performed, and therefore, a precise accompaniment is possible, without player's chord specifying.

What is claimed is:

1. A chord detecting device comprising:

note data storage means for storing note data of music for each of a plurality of specified sections in a period;

first chord storage means for storing a first chord corresponding to the note data of a first section of the plurality of specified sections in the period;

tonality data supply means for supplying tonality data; and chord imparting means for imparting a second chord in a second section of the plurality of specified sections of the period according to (1) note data at the beginning of the second section, (2) the tonality data supplied by the tonality data supply means, and (3) the first chord stored in the first chord storage means.

2. A chord detecting device according to claim 1, wherein said tonality data supply means detects the tonality data based on a progression of chords and supplies the detected tonality.

3. A chord detecting device according to claim 1, wherein said chord imparting means determines candidate chords first based on the note data at the beginning of the second section, and selects the second chord in the second section from the candidate chords.

4. A chord detecting device according to claim 3, wherein said chord imparting means uses a chord extraction table for determining said candidate chords and a priority order table for selecting said second chord based on (1) said tonality data supplied by said tonality data supply means, and (2) the first chord stored in the first chord storage means.

5. A chord detecting device comprising:

note data storage means for storing note data of music for each of a plurality of specified sections in a bar;

tonality data supply means for supplying tonality data;

temporary chord imparting means for imparting a temporary chord to a first section of the plurality of specified sections of the bar at a beginning of the first section according to a previous chord of an immediately prior section, the tonality data and note data corresponding to the beginning of the first section stored in the note data storage means; and fixed chord imparting means for imparting a fixed chord to the first section of the bar at a beginning of a second section of the plurality of specified sections of the bar according to (1) note data within the first section stored in the note data storage means, (2) the tonality data and (3) a previous chord of an immediately prior section.

6. A chord detecting device according to claim 5, wherein said temporary chord imparting means further imparts a second temporary chord to the first section of the bar at a specified timing in the first section according to (1) the temporary chord imparted by said temporary chord imparting means, (2) said tonality data and note data between the beginning of the first section and (3) the specified timing stored in said note data storage means.

7. An automatic accompaniment device having a chord detecting device comprising:

note data storage means for storing note data of music for each of a plurality of specified sections in a bar;

tonality data supply means for supplying tonality data;

temporary chord imparting means for imparting a temporary chord to a first section of the plurality of specified sections of the bar at a beginning of the first section according to a previous chord of an immediately prior section, the tonality data and note data corresponding to the beginning of the first section stored in the note data storage means;

fixed chord imparting means for imparting a fixed chord, which becomes a previous chord for a second section of the plurality of specified sections of the bar, to the first section of the bar at a beginning of the second section of the bar according to (1) note data within the second section stored in the note data storage means, (2) the tonality data and (3) the temporary chord of the first section imparted by the temporary chord imparting means; and 8. An automatic accompaniment device having a chord detecting device according to claim 7, further comprising fixed chord input means for inputting said fixed chord, and wherein said fixed chord imparting means is activated only when the fixed chord is not inputted by the fixed chord input means.

9. An automatic accompaniment device having a chord detecting device according to claim 7, wherein said fixed chord input means comprises a left side of a keyboard and a chord detecting means for detecting said fixed chord according to a combination of depressed keys on the left side of the keyboard.

* * * * *